US005601099A

United States Patent [19]

Mochizuki et al.

[11] Patent Number: 5,601,099

[45] Date of Patent: Feb. 11, 1997

[54] METHOD FOR HAIR JOINING, HAIR USED FOR THE METHOD, AND JOINING HAIR RETAINER

[75] Inventors: Kousuke Mochizuki; Ryuji Teratoko, both of Tokyo, Japan

[73] Assignee: Aderans Co., Ltd., Tokyo, Japan

[21] Appl. No.: 480,057

[22] Filed: Jun. 7, 1995

Related U.S. Application Data

[62] Division of Ser. No. 230,836, Apr. 21, 1994, Pat. No. 5,497,796.

[30] Foreign Application Priority Data

Apr. 27, 1993 [JP] Japan ..... 5-100640
Apr. 27, 1993 [JP] Japan ..... 5-100641

[51] Int. Cl.[6] ..... A41G 3/00; A41G 5/00

[52] U.S. Cl. ..... 132/201; 132/53; 132/54; 132/56

[58] Field of Search ..... 132/53, 54, 56, 132/201

[56] References Cited

U.S. PATENT DOCUMENTS 2,621,663 12/1952 Jenkins .
2,865,380 12/1958 Mitchell .
3,910,291 10/1975 Kim ..... 132/53
5,072,745 12/1991 Chen .
5,121,761 6/1992 Meister .
5,137,037 8/1992 Mochizuki ..... 132/53
5,368,052 11/1994 Finamore .

FOREIGN PATENT DOCUMENTS 56-170222 12/1981 Japan .
61-97409 5/1986 Japan .
3-152205 6/1991 Japan .
4108106 4/1992 Japan .
6002207 1/1994 Japan .
2271057 4/1994 United Kingdom .

*Primary Examiner*—Gene Mancene
*Assistant Examiner*—Pedro Philogene
*Attorney, Agent, or Firm*—Fish & Richardson, P.C.

[57] ABSTRACT

A retainer used for hair joining includes a retainer body, a rod-like member on one end portion of the retainer body, and an elongated cushion member which has multiple cuts and which is arranged on the retainer body such that it is spaced apart from the rod-like member. Reducible looped portions are formed on one end of each of multiple joining hairs to allow the rod-like member to pierce therethrough. The free ends of the multiple joining hairs are clamped by the plurality of cuts in the cushion member.

12 Claims, 8 Drawing Sheets

METHOD FOR HAIR JOINING, HAIR USED FOR THE METHOD, AND JOINING HAIR RETAINER

This is a division of application Ser. No. 08/230,836, filed Apr. 21, 1994 now U.S. Pat. No. 5,497,796.

BACKGROUND OF THE INVENTION

1. Field of the Invention

This invention relates to a method for relatively increasing the number of hairs, for example, on the scalp of a person's head that needs more hair, or on a wig that needs supplement of hairs by securing strands of joining hair (hairs to be joined) to live hairs or artificial hairs. The invention also relates to the joining hair used for the method, and a tool or device for retaining the joining hair (i.e., joining hair retainer).

2. Description of the Related Art

Typically, two approaches are heretofore made to the problem for thickening human hair; one is a surgical hair implanting method, for thickening the hair by means of implanting hairs into the scalp of a person's head in a surgical manner, and the other is a method for securing joining hair to live hair of a person who needs more hair. The latter is further sub-divided into two; one is for attaching the joining hair to live hair by adhesive, and the other is to tie a joining hair element to the area in the vicinity of the root of individual live hair.

The surgical hair implanting method is a method for implanting a joining hair directly to the scalp of the person's head, as disclosed, for example, in Japanese Laid-Open Utility Model Publication No. Sho 56-170222 in which an anchor type joining hair is implanted in the scalp of a person's head by a needle-like device or jig designed for the exclusive use of implanting hair.

However, since the first-mentioned surgical implanting method is for implanting joining hair directly into the scalp of a person's head in order to thicken hair, this conduct falls on a general surgical treatment which can be done only by those who have a qualification certificate or license as a surgeon. Moreover, since the above method requires a special technique, it cannot be carried out easily. In addition, since hairs are implanted into the scalp, there is a possibility that various germs enter inside the scalp to cause a suppuration of the scalp or rejection (symptoms) sets in the living body.

As one of the second-mentioned methods, the method for thickening hair using an adhesive is disclosed for example in Japanese Laid-Open Patent Publication No. Sho 61-97409, in which a single strand or a group of strands of joining hair is bonded to a single strand of natural hair on the scalp of a person's head by an adhesive.

According to this method, a single strand or a group of 2 to 6 strands of joining hair cut into a proper length are aligned at one ends thereof and placed along a single strand of natural hair, and then bonded at basal end portions of the joining hairs to the root portion of the natural hair in the manner as to form a branch while applying an adhesive. As the adhesive, silicon resins, polyurethane resins or epoxy resins are used.

However, since the adhesives of silicon or polyurethane resins take long time for hardening, workability is bad. On the other hand, the adhesives of epoxy resins tend to cause itching, rash, eruption, etc. on the skin and therefore, they are not suitable in view of safety.

In order to elude these problems, there is proposed a hair thickening method in which a hot melt adhesive is used instead of the above-mentioned adhesive. This method is laid open to public inspection as the invention of the present applicant, on Jun. 28, 1991, under Japanese Laid-Open Patent Publication No. Hei 3-152205. According to this method, in order to perform the hair joining work efficiently, hairs to be joined to a single strand of a natural hair on the scalp of a person's head are beforehand grouped, for example, five (5) hair strands as one group, and the basal end portions of these joining hair strands are aligned. Then, a hot melt adhesive is applied to the grouped hair strands at areas about a few millimeters (2 to 3 mm) from the basal end portions and hardened by drying. Preferably, a plurality of grouped hair strands such obtained are beforehand prepared. For hair thickening work, one group of hair strands is spirally wound around the area in the vicinity of the root of a single natural hair strand and then the hot melt agent, which has been applied to and hardened on the basal end portion of the group of hair, is softened by heating using a suitable heating instrument such as a heating trowel, so as to be bonded to the natural hair. Thereafter, they are left as they are under normal temperature until the adhesive is cooled and hardened, whereby the joining hair is firmly attached to the natural hair.

Obviously, this method has a number of advantages, as, the joining hairs are positively attached to the natural hair and not easily come off by washing, brushing, etc., the joining hairs are not readily removed or detached even if they are exposed to and attacked by sweat, oil and hair lotion. Moreover, since the hot melt adhesive does not take long time for softening and hardening, workability is good. In addition, since the hot melt adhesive hardly reacts with the scalp, it is safe. However, since the joining hairs are attached to the natural hair in the condition that the hot melt adhesive is softened by heating, the use of an instrument such as a heated trowel is necessary when the joining hairs are attached to the natural hair. Therefore, handling is difficult. Besides, there is a possibility that the scalp is burnt when the heating trowel of high temperature is inadvertently left in contact with the scalp for a long time.

With respect to another conventional method in which joining hair is tied to an area in the vicinity of the root of the natural hair on the scalp of a person's head, a single or a few strands of joining hair are sequentially tied to the natural hair. Specifically, a single strand of natural hair is held with a finger(s) of one hand , and while maintaining this condition, a hair implanting needle held with a finger(s) of the other hand is brought into engagement with a generally central portion of a folded part of the joining hair and then, the needle is carefully manipulated so that the joining hair is wound around the area in the vicinity of the root (preferably, nearest possible area to the root) of the natural hair. Subsequently, a free end portion of the natural hair is pierced through a ring-shaped folded-back portion and tightly tied. As seen, for tying a few joining hair strands to a single natural hair strand, it is required such an extremely troublesome work that while holding the single natural hair strand with a finger(s) of one hand, a loop or ring of the joining hair is formed with a finger(s) of the other hand. Obviously, it will take a considerably long time period for the work for tying the joining hairs to, for example, 1,000 or more strands of natural hair. In addition, if the joining hairs are tied to the natural hair(s) in accordance with this conventional method, the joined hairs tend to extend, unlike the natural hair, in a horizontal direction instead of vertical direction, thus providing an unnatural outlook of the hair.

It is therefore an object of the present invention to provide a hair joining method and a joining hair used for the method in which a hair joining work can be made by anybody, in a handy manner, in a short time and yet efficiently, and which is suitable for long life and hardly susceptible to the risk for burning the scalp of a person's head.

Another object of the invention is to provide a joining hair retainer which is capable of retaining so many strands of hair as several hundreds to several thousands in the condition ready to be used by those who are engaged in a hair joining work, such as barbers or hair dressers, so that the barbers, etc. may engage themselves in a hair thickening or joining work with high efficiency whenever it is required.

SUMMARY OF THE INVENTION

From one aspect of the present invention, there is provided a method for joining hair comprising the steps of beforehand forming a reducible loop on one end of a strand of joining hair, reducing and tightening the loop after piercing therethrough a strand of natural hair growing on the scalp of a person's head or a strand of hair implanted in a wig (this hair to be tied will be hereinafter referred to as "stationary hair"), and weaving and tying together both of the joining hair and stationary hair in a manner the joining hair may be firmly joined to the stationary hair.

Preferably, the loop is formed by folding at least one joining hair into two and piercing free ends of said at least one joining hair into the folded portion. This loop or looped portion is then heated to curl so that the looped portion may not be lost or straightened.

According to the hair joining method thus constructed, since additional hair is joined directly to the stationary hair instead of implanting the additional hair directly into the scalp, the person, who engages in this hair joining work, is not required to have a qualification certificate or license as a surgeon. In other words, any person can do this work easily. Since it is not necessary to use adhesive, there are such advantages that a long life is obtained and the trowel of high temperature or the like is no more necessary. Furthermore, the joining hair made in accordance with the present invention has a loop beforehand formed on one end thereof and retained in such a manner as not to lose or straighten the loop. Since it is unnecessary to form a ring or loop on the joining hair every time the joining hair is joined to stationary hair, the hair joining work will become easy and working efficiency can be enhanced.

With respect to the joining hair constructed in the manner as mentioned above, since the loop is reduced or wrung merely by pulling the free end of the joining hair and the joining hair is firmly joined to the basal end portion of the stationary hair, this hair can be suitably used for the hair joining method. Also, if the stationary hair and joining hair are weaved several times, the joining hair can be more firmly joined to the stationary hair.

In the above hair joining method, in case a plurality of joining hair strands each having a loop are preliminarily retained on a retainer and then joined to the stationary hair, many strands of joining hair can be joined efficiently in a short time.

The stationary hair may be the natural hair growing on the head of a person who needs more hair. Otherwise, it may be natural hair or artificial hair implanted in a wig, in which the joining hair can be used for recovering the detached hair, if any, of the wig.

According to the present invention, since the looped portion of the joining hair is subjected to heat treatment at a temperature lower than a melting point of the material which composes the hair, the loop shape or contour can be maintained until the day the hair joining work is performed. Therefore, the hair joining work can be done more efficiently.

From another aspect of the present invention, there is also provided a joining hair retainer comprising a retainer body, a rod-like member disposed on one end portion of the retainer body, and an elongated cushion member disposed on the retainer body in such a manner as to be spaced apart from the rod-like member, and having a plurality of cuts, reducible looped portions formed on one ends of a plurality of joining hairs allowing the rod-like member to pierce therethrough and free ends side thereof being inserted respectively into and clamped by the plurality of cuts in the cushion member.

According to the above-mentioned construction, several hundreds joining hair strands each having a reducible loop beforehand formed on one end thereof can be retained on the joining hair retainer in the condition that the looped shape is maintained. Therefore, since those joining hairs with the loops can be readily used by a barber, the hair joining work can be performed with high efficiency.

If the loops of the joining hair strands with the rod-like member pierced therethrough are heated in order to maintain the looped shape, since the barber is not required to pay utmost care to hold the looped portion of each joining hair strand, the hair joining work can be performed in a more efficient manner. Acceptable heat treatment includes heating by hot air, vapor, built-in heater and the like.

If a large unit of joining hair retainer is constructed by securing a plurality of joining hair retainers onto a mount in parallel relation, the hair joining work can be performed with highest efficiency because several thousands to ten thousands or more of joining hair strands can be retained without losing the looped shape.

If the joining hair retainers are vacuum packed as a whole, handling of the hairs may become easier because the joining hairs will not be escaped and the looped shape will not be lost even if the retainers are stacked up or handled in a wild manner.

It may be arranged such that the retainer body is of a generally U-shaped frame and the rod-like member is retained in the state bridging over opposite distal end portions of the U-shaped frame, with the cushion member disposed on a basal end side of the frame away from the rod-like member. In this case, since a space is formed between the retainer body and the rod-like member, joining hair or hairs can easily be removed from the retainer through this space.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

One embodiment of a hair joining method according to the present invention will be described with reference to FIGS. 1 through 13.

Figure 1:
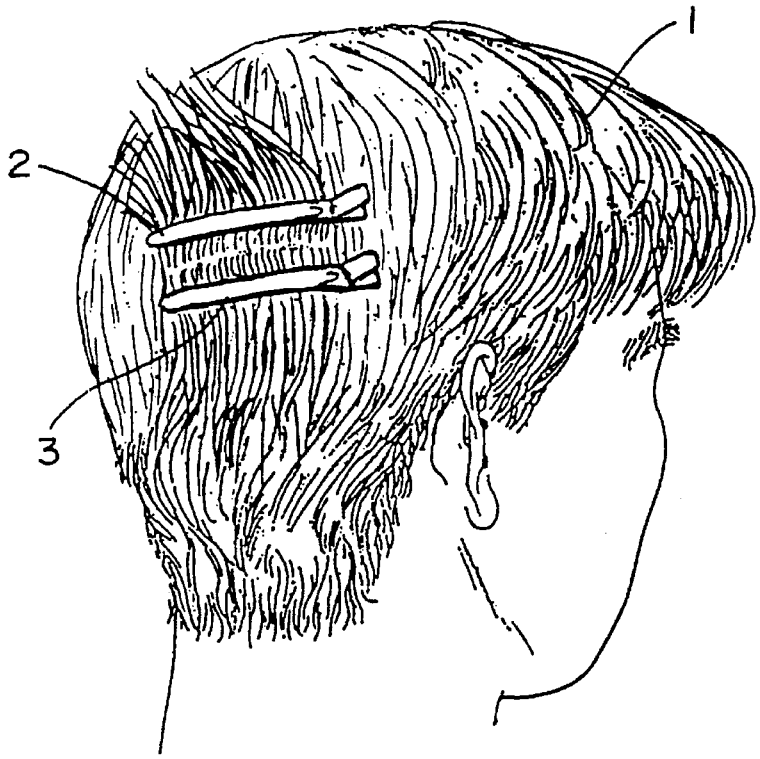
FIG. 1 is a perspective view showing the first stage of one embodiment of a method for thickening hair according to the present invention.

First, as shown in FIG. 1, stationary hairs 1 (which are, in this embodiment, those hairs growing on the head of a person who needs more hair) on that area where additional hairs are to be applied, are divided into two and the hairs 1 are pressed with curl pins (or clippers) 2 and 3 so that root portions of the stationary hairs 1 to be added with additional hair are exposed.

Figure 2:
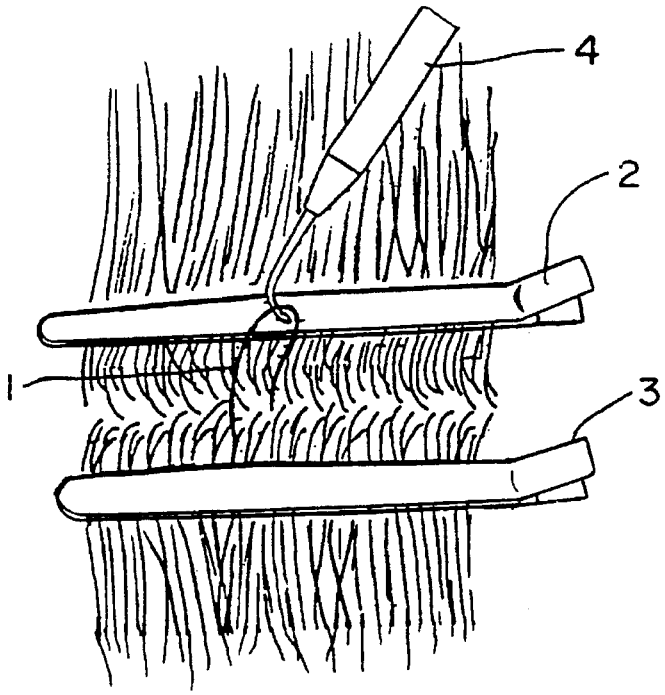
FIG. 2 is a perspective view showing the second stage of the above embodiment.

Then, as shown in FIG. 2, a single strand of stationary hair 1 to be added with additional hair is pulled out about 1 cm. At this time, that portion of the stationary hair 1 which has been pulled out forms a semi-looped shape.

Figure 3:
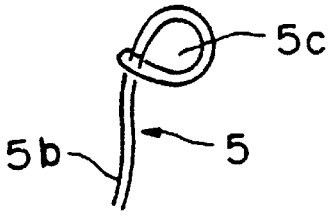
FIG. 3 is a perspective view showing one example of a joining hair element which is to be used in the above embodiment.
Figure 4:
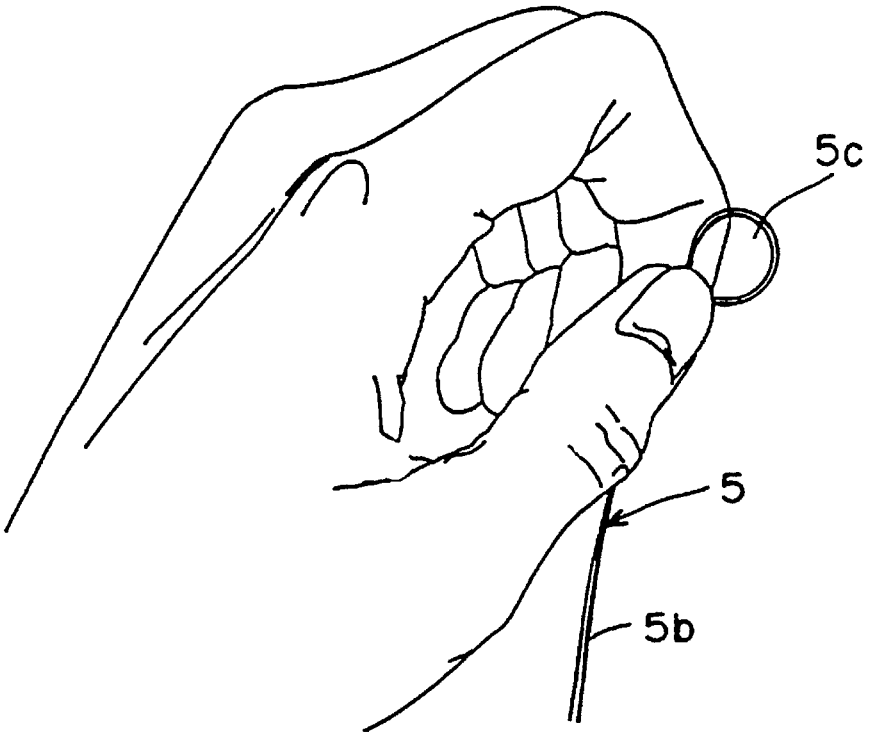
FIG. 4 is a perspective view showing the third stage of the above embodiment.

Subsequently, as shown in FIG. 3, a single or a plurality of joining hairs 5 are folded into two and a loop 5*c* is formed by piercing free ends 5*b* of the hairs 5 through such folded portion 5*a*, thereby constituting the joining hairs 5. As shown in FIG. 4, the joining hairs 5 are held between the thumb and the index finger of one hand so that the looped shape will not be lost or straightened. For example, two strands of joining hair are folded together as a bundle of hairs. If this bundle of hairs are joined to a single strand of natural hair on the scalp of a person's head, five tips of hairs are obtained in total. This means that four strands of hair are increased in total.

Figure 5:
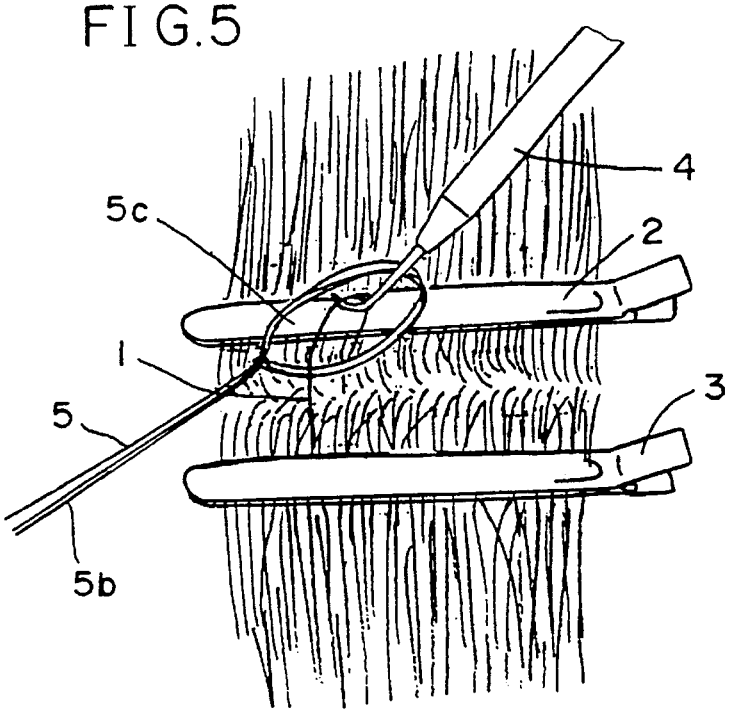
FIG. 5 is a perspective view showing the fourth stage of the above embodiment.

Then, as shown in FIG. 5, the loop 5*c* of the joining hairs 5 is pierced through the semi-looped portion of the stationary hair 1 and the whole stationary hair 1 is pulled out by hooking the semi-looped portion with a hair implanting needle 4.

Figure 6:
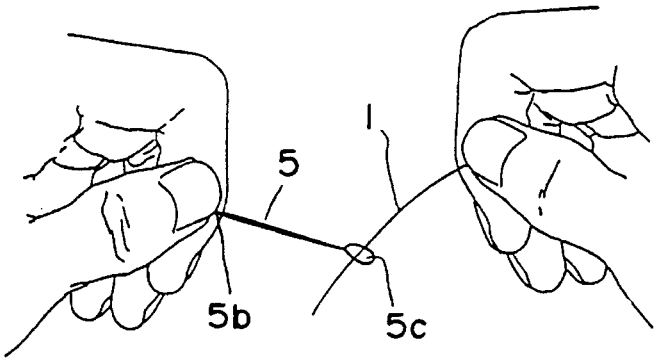
FIG. 6 is a perspective view showing an intermediate step of the fourth stage.
Figure 7:
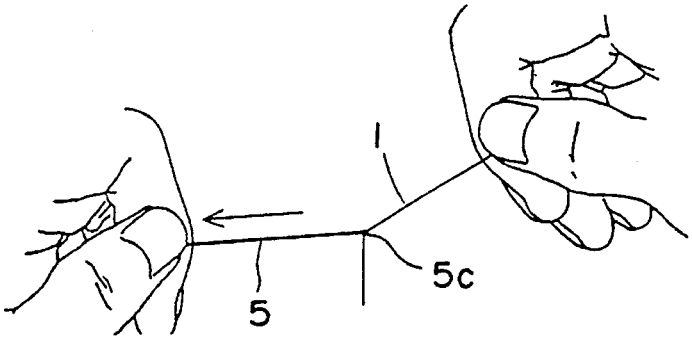
FIG. 7 is a perspective view showing an intermediate step of the fourth stage of the above embodiment.
Figure 8:
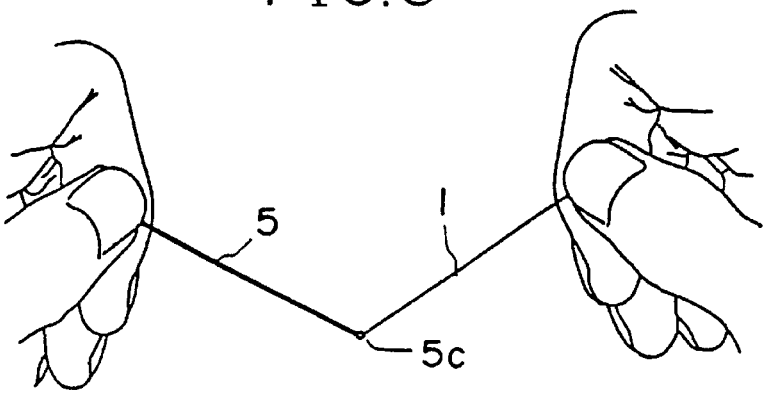
FIG. 8 is a perspective view showing a final step of the fourth stage of the above embodiment.

Then, as shown in FIG. 6, the free ends 5*b* of the joining hairs 5 are held between the thumb and the index finger of one hand (left hand in the illustrated example), while a free end of the stationary hair 1 is held likewise between the thumb and the index finger of the other hand (right hand, for example). Then, as shown in FIG. 7, the loop 5*c* is reduced by pulling the free ends 5*b* of the joining hairs 5 and the loop 5*c* is tightened with a tip of one finger of the other hand catching an outer edge of the loop 5*c*. Thereafter, the free ends 5*b* of the joining hairs 5 held between the thumb and the index finger of said one hand and the free end of the stationary hair 1 held likewise between the thumb and the index finger but of the other hand are pulled in a direction away from each other on a same linear line with an equal force so that the loop 5*c* is lowered to the root of the stationary hair 1 where the loop 5*c* is secured to the stationary hair 1 at the root portion as shown in FIG. 8.

Figure 9:
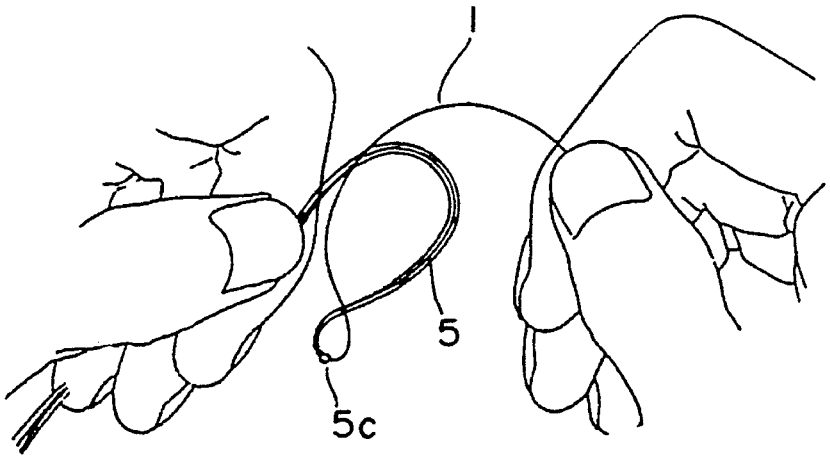
FIG. 9 is a perspective view showing an intermediate step of the final stage of the above embodiment.
Figure 10:
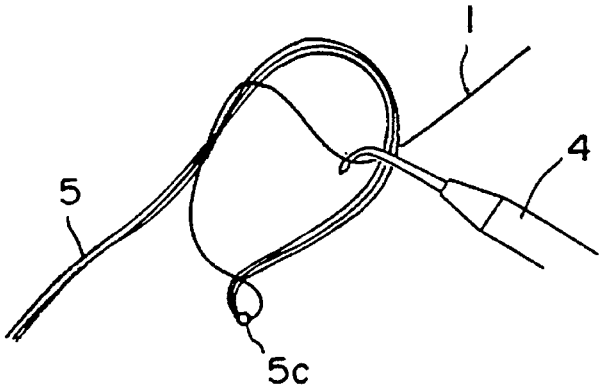
FIG. 10 is a perspective view showing an intermediate step of the final stage of the above embodiment.

Subsequently, the joining hairs 5 are bent or flexed, and as shown in FIG. 9, the stationary hair 1 is placed thereon first with this side and the overlapped portion is held between the thumb and the index finger of said one hand. Then, as shown in FIG. 10, the stationary hair 1 is pulled out from the inside of the flexed portion of the joining hairs 5 using the hair implanting needle 4 and the stationary hair 1 is twisted about the joining hairs 5 in such a manner as to weave them together.

Here, since the stationary hair 1 and joining hairs 5 are woven in flexed condition, the root portions are twisted.

Figure 11:
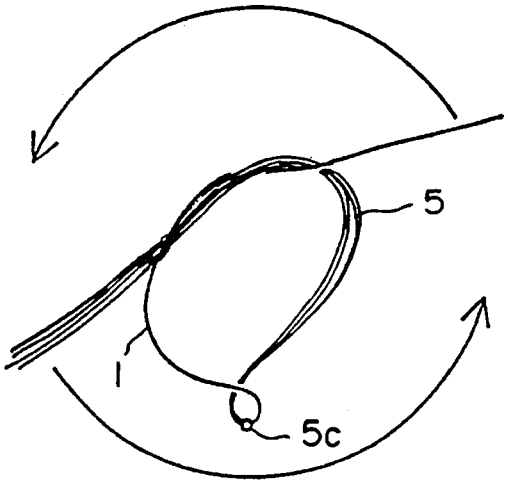
FIG. 11 is a perspective view showing an intermediate step of the final stage of the above embodiment.
Figure 12:
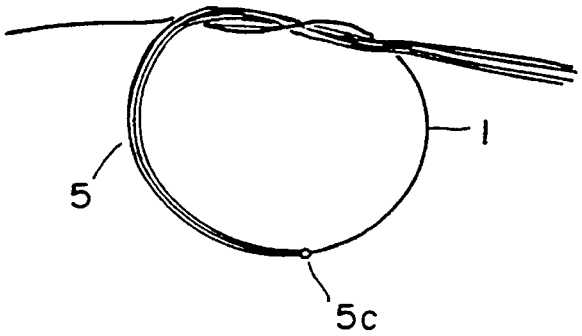
FIG. 12 is a perspective view showing an intermediate step of the final stage of the above embodiment.
Figure 13:
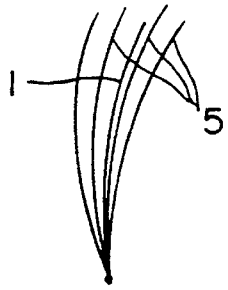
FIG. 13 is a perspective view showing a completed state of the addition of joining hair according to the above embodiment.

Therefore, as shown in FIG. 11, the loop is inverted in a direction which both the hairs 1 and 5 tend to restore, so that the roots of the stationary hair 1 and joining hairs 5 are relieved from twisting as shown in FIG. 12. Then, the free end of the stationary hair i held between the thumb and the index finger of one hand and the free end 5*b* of the joining hairs 5 held likewise between the thumb and the index finger but of the other hand are further pulled in a direction away from each other on a same linear line with an equal force so that the loop (i.e., tie or knot) is tightened up beautifully and correctly. In this way, as shown in FIG. 13, a plurality of joining hair 5 strands are attached or jointed to the root of the stationary hair 1. The joining hairs 5 thus joined keep their upstanding postures (in other words, the joining hairs 5 extend in a direction normal to a person's head) like the stationary hair 1 and are not liable to fall sidewardly or downwardly. Therefore, the thickened hairs, either as a whole or individually, look very natural as if they grow on a person's head.

According to the hair joining method so far described in detail, since the joining hair or hairs 5 are joined directly to the stationary hair 1 growing on the scalp of a person's head instead of implanting the joining hairs 5 directly in the scalp of a person's head, those who engage in this hair joining work are not required to have a qualification certificate or license as a surgeon. This means that anybody can do this easily. Moreover, since no adhesive is used, a long life is obtained and there is no possibility that the scalp is burnt by a trowel of high temperature, etc.

The number of twisting or weaving of the stationary hair 1 and joining hairs 5 may be one before the knot or tie is tightened. However, it is preferable that they are twisted at least twice. By doing so, the joining hairs can be more positively secured to the stationary hair.

The stationary hair is not limited to the natural hair growing on the head of a person who needs more hair but may be natural or artificial hair implanted in a wig.

Likewise, the joining hair 5 may include natural hair and artificial hair. Acceptable material of the artificial hair includes modacryle, polyamide, polyester, and the like.

If the loop 5*c* portion of the joining hairs 5 is subjected to heat treatment at a temperature lower than a melting point of the hairs 5 so that the looped shape may be maintained for a long period of time, the hair joining work can be performed in a more efficient manner.

The joining hairs 5, which may be natural or artificial hairs, are preferably heated at a temperature of 150° C. or less, for 0.1 sec. or more.

Particularly, in the case where the material of the joining hair 5 is modacryle, the looped shape can be fixed by blowing a hot air having a temperature of 90° C. to 120° C., for 0.1 sec. or more, using a hair dryer. In the case where the material is polyamide, the looped shape can be fixed by heating at a temperature of 120° to 150° C., for three to five minutes, using a high temperature dryer.

In this hair joining method, it is a somewhat troublesome job to form a reducible loop on one end of the joining hair and maintain this looped shape. In order to practice this hair joining method efficiently, it is not only important but also effective that several hundreds to several thousands of joining hair strands each having a reducible loop formed on one end thereof are preliminarily retained while maintaining the looped shape, so that a barber can readily use them.

A joining hair retainer will now be described, in which several hundreds to several thousands of joining hair strands each having a reducible loop beforehand formed on one end thereof are retained while maintaining the looped shape, so that a barber can readily use them for an efficient hair joining work.

Figure 14:
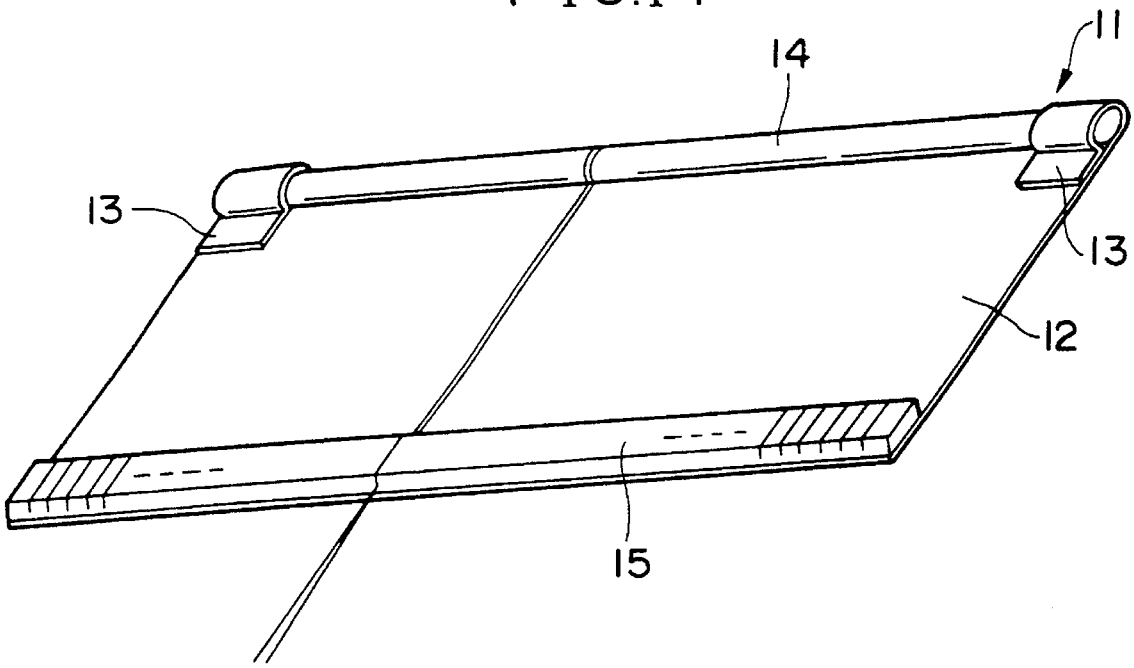
FIG. 14 is a perspective view of one embodiment of a joining hair retainer according to the present invention.

FIG. 14 shows one embodiment of a joining hair retainer according to the present invention. This joining hair retainer 11 comprises a plate-like base 12 formed of a thick paper material or the like, a rod-like member 14 whose opposite ends are secured to an edge portion of one end of the base 12 by an adhesive tape 13 or the like, and a cushion member 15 secured to the other end portion of the base 12 opposite to the rod-like member 14 by adhesive. The rod-like member 14 can be formed into a sleeve or cylindrical configuration from a wood, metal or hard plastic material such as, for example, polyethylene, so that it may have a generally equal or slightly smaller outer diameter (for example, about 4 mm to 10 mm) than the diameter of the loop 5*c* of the joining hair 5 and a length of about 15 cm to 23 cm, for example. The cushion member 15 is formed, for example, of an elongated sponge member of a rectangular section having a length generally equal to that of the rod-like member 14. A corresponding number (for example, 125) of cuts 15*a* to the number of the sets of joining hairs 6 to be retained, are formed in an upper surface of the cushion member 15 in such a manner as to extend to a generally middle part of the thickness of the cushion member. The cushion member 15 is secured at a bottom surface thereof to top of the base 12 by adhesive.

For retaining the joining hairs 5 to the joining hair retainer 11 thus constructed, as shown in FIG. 3, the joining hairs 5 with the loops 5*c* are passed on the rod-like member 14 allowing the rod-like member 14 to pierce therethrough. In this way, a large number of sets (for example, 125 sets) of joining hairs 5 are hung on the rod-like member 14. In that condition, the opposite ends of the rod-like member 14 are secured to the edge portion of one end of the base 12 by the adhesive 13. Then, the free ends 5*b* side of the joining hairs 5 are inserted for retaining respectively into the cuts 15*a* of the cushion member 15 which is secured to the edge portion of the other end of the base 12. Let's presume here that two joining hair elements, for example, are bundled and folded back at intermediate part thereof to form a loop at that location and such folded-back joining hair elements with a number, four, of hair tips are prepared as one set. And 125 sets of such joining hair elements are retained by the joining hair retainer 11. Then, if a hair joining work is performed using a single number of such joining hair retainer 1,500 hair elements are eventually increased in total.

According to the above construction, several hundreds (for example, 125 sets) of joining hairs 5 each with a reducible loop 5*c* beforehand formed on one ends thereof are retained by the retainer 11 in the condition that the looped shape is maintained. Since these joining hairs 5 are readily useable for a barber, a hair joining work can be performed with high efficiency.

Figure 15:
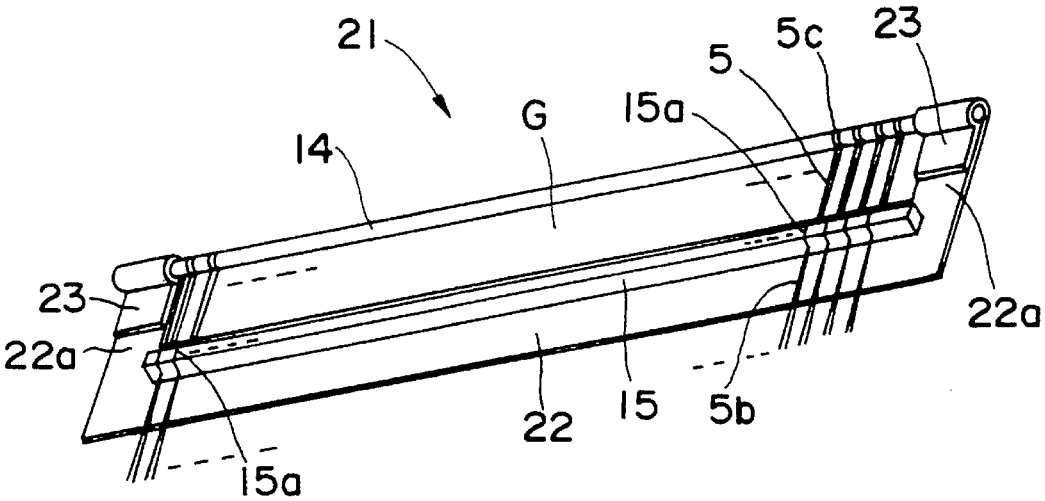
FIG. 15 is a perspective view of another embodiment of a joining hair retainer according to the present invention.

FIG. 15 shows another example of a joining hair retainer. In this joining hair retainer 21, a generally U-shaped frame 22 which is made by cutting out a sheet of thick paper, and support portions 23, 23 for a rod-like member 14 are formed by roundly folding back opposite distal end portions of the U-shaped frame 22 and securing them to the frame 22. By having the support portions 9–3, 23 support the opposite ends of the rod-like member 14 which is made of a hard polyethylene tubular material or the like, the rod-like member 14 is bridged between and over the distal end portions 22*a*, 22*a* of the U-shaped frame 22. In that condition, there is a space G formed between the rod-like member 14 and the frame 22. An elongated cushion member 15 having a plurality of cuts 15*a* is secured to a basal portion side of the frame 12 in spacedly parallel relation to the rod-like member 14.

The reducible loop 5*c* formed on one end of each set of joining hairs 5 of FIG. 3 is passed on the rod-like member 14 in a way to allow the rod-like member 14 to pierce therethrough, and other ends 5*b* of the sets of joining hairs 5 are inserted respectively into and held by the cuts 15*a* of the cushion member 15. Thereafter, the looped portions 5*c* are subjected to heat treatment so as to be curled.

Figure 16:
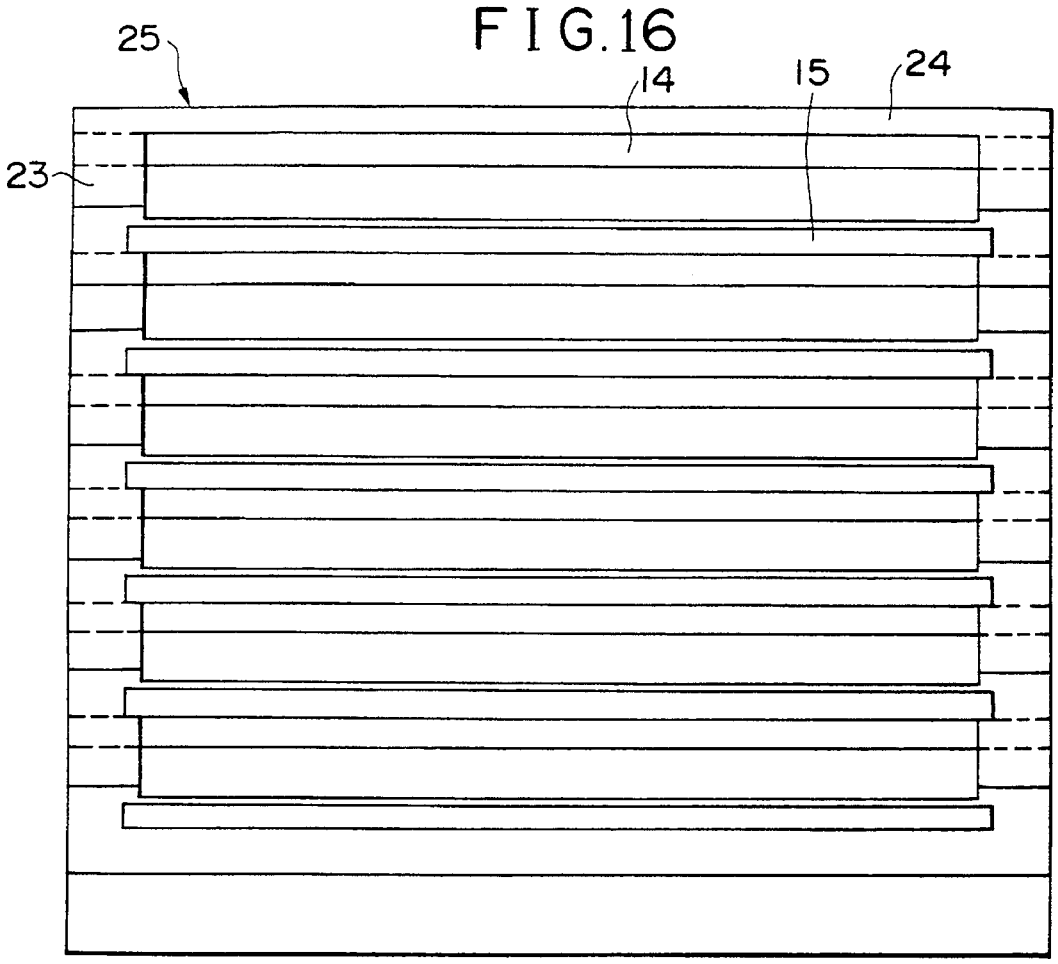
FIG. 16 is a plan view of one unit consisting of a plurality of joining hair retainers of FIG. 15, juxtaposed in multistage.

As shown for example in FIG. 16, if a plurality of sets (for example, six (6) sets) of such manufactured joining hair retainers 21 are secured in parallel relation onto the outer side of a mount 24 and another six (6) sets are secured likewise in parallel relation onto a reverse side of the mount 24 so as to constitute a joining hair retainer unit 25, several thousands to 10 thousands or more of joining hairs 5 can be retained only by this unit 25, in the satisfactory condition that the looped shape is maintained. Therefore, a hair joining work can be performed in a more efficient manner. For example, if 12 sets of joining hair retainers 21, in total, each retaining 125 sets of joining hairs 5 (if one set consists of two strands of joining hair, 250 strands in total), are secured to the mount 24 in parallel relation, 1,500 sets of joining hairs 5 can be prepared by one retainer unit 25. If these joining hairs are joined to 1,500 strands of natural hair or stationary hair, 6,000 strands of hair can be increased in total.

Furthermore, if the joining hair retainer unit 25 thus constructed is totally vacuum packed, there is no fear that the joining hairs are detached and the looped shape gets out of shape even if the unit is handled in a somewhat wild manner.

The frame 22 and support portion 23 may be formed of any suitable material such as plastic, metal and the like. The quality of the material of the rod-like member 14 is likewise not questioned (in other words, any suitable material may be employed).

Figure 17:
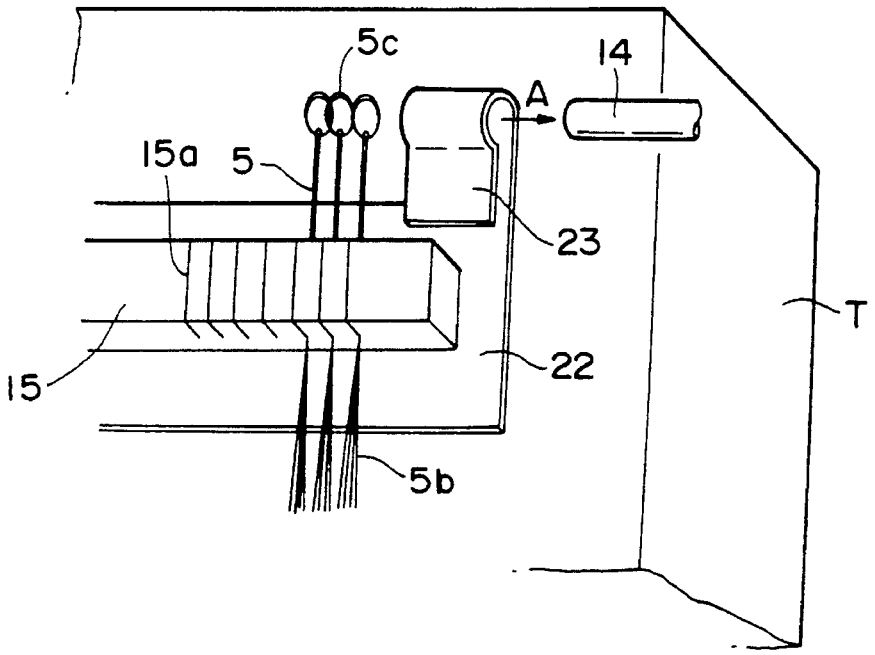
FIG. 17 is an explanatory view for increasing the number of hair elements with the use of the joining hair retainer of FIG. 15.

For performing a hair joining work using the joining hair retainer unit 25 of FIG. 16, first, one set of retainer 21 is removed from this unit 25. At this time, if the reverse surface of the joining hair retainer 21 is attached to the unit 25 with a double faced adhesive tape, the retainer 21 can easily be removed from the unit 25. Then, as shown in FIG. 17, the joining hair retainer 21 is attached to the wall or a working table T, etc., near a technician (barber, for example) who engages in the hair joining work by this double faced adhesive tape. Then, only the rod-like member 14 is withdrawn from one of the supports 23 as indicated by an arrow A of FIG. 17. As a result, the joining hairs 5 are retained in their upright postures, with the free ends 5*b* side thereof held in the cuts 15*a* of the cushion member 15. In that condition, the loops 5*c* of the joining hairs 5 supported are spacedly erected without contacting the wall or working table T. Therefore, the technician or barber can easily withdraw the joining hairs 5 from the cushion member 15 by his hand or using the hair implanting needle. Consequently, a hair joining work can be performed efficiently.

Figure 18:
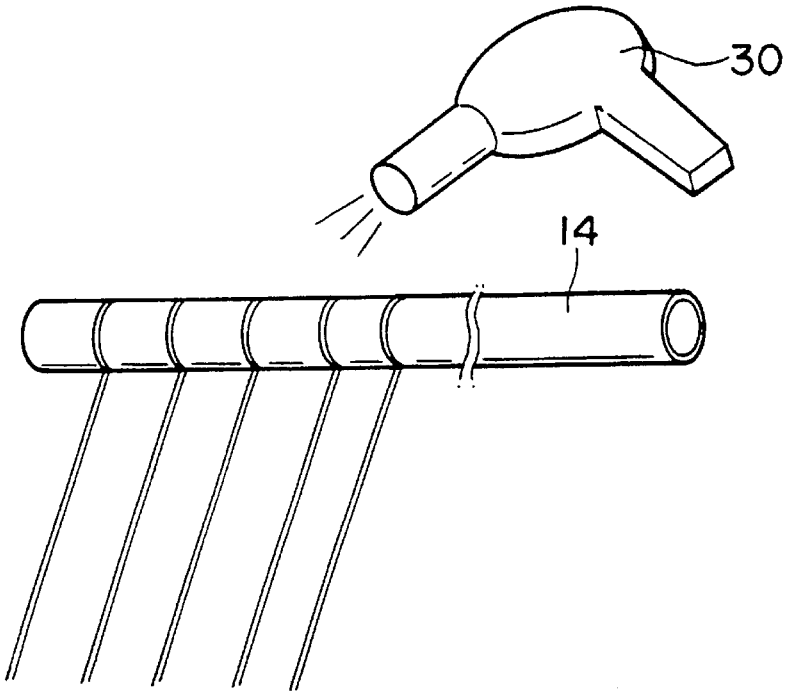
FIG. 18 is an explanatory view for forming loops at one ends of joining hair elements, which are wound on a rod-like member, with the help of hot air.

In order to form the loop 5*c* of FIG. 3 on the joining hair 5, it is convenient that the loop 5*c* is formed while twisting or winding the joining hair 5 about the rod-like member 14. Thereafter, as shown in FIG. 18, by blowing a hot air to the rod-like member 14 by a hair dryer 30 or the like, the joining hair 5 can be curled so that the loop 5*c* can be maintained for a long period of time.

Figure 19:
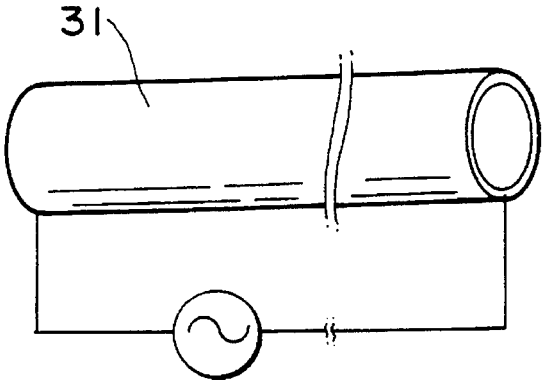
FIG. 19 is an explanatory view in which a cylindrical heater is served as the rod-like member.

As shown in FIG. 19, the rod-like member itself may be formed into a cylindrical heater 31 so that the joining hair is curled by this heater 31.

Figure 20:
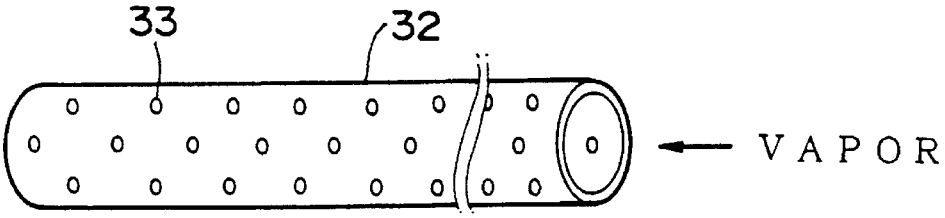
FIG. 20 is an explanatory view for forming loops at one ends of joining hair elements by feeding vapor into the rod-like member through a plurality of small holes formed in the surface of the rod-like member.

Alternatively, as shown in FIG. 20, a vapor heating system may be employed. In this case, a rod-like member 32 is provided with a number of small holes 33 formed in an entire surface thereof and a vapor is introduced into this rod-like member 32 so as to be jetted out through the small holes 33.

In any system, the heating conditions are the same as mentioned above.

In this way, if the loop 5*c* of the joining hair 5 is subjected to heat treatment so that the looped shape can be maintained, the loop 5*a* does not get out of shape easily even if the looped portion is not handled with an utmost care after the joining hair 5 is removed from the retainer 1. Therefore, a hair joining work can be performed efficiently.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A joining hair retainer comprising:

a retainer body;

a rod-like member disposed on one end portion of said retainer body; and an elongated cushion member disposed on said retainer body in such a manner as to be spaced apart from said rod-like member, and having a plurality of cuts;

reducible looped portions formed on one ends of a plurality of joining hairs allowing said rod-like member to pierce therethrough and free ends side thereof being inserted respectively into and clamped by said plurality of cuts in said cushion member.

2. A joining hair retainer as claimed in claim 1, wherein said looped portions of said joining hairs, with said rod-like member pierced through said looped portions, are heated to curl so that said looped shape can be maintained.

3. A joining hair retainer as claimed in claim 2, wherein said heating is effected by blowing hot air to said rod-like member which has pierced through said joining hairs.

4. A joining hair retainer as claimed in claim 2, wherein said heating is effected by a heater contained in said rod-like member which has pierced through said joining hairs.

5. A joining hair retainer as claimed in claim 2, wherein said rod-like member is formed of a tubular material having a plurality of small holes through which vapor can be externally introduced therein, and said heating is effected by the vapor ejected from said small holes of said rod-like member which has been pierced through said joining hairs.

6. A joining hair retainer comprising:

a generally U-shaped frame member a rod-like member bridged over opposite distal end portions of said frame member; and an elongated cushion member firmly secured to said frame member in a manner spacedly parallel to said rod-like member and having a plurality of cuts;

reducible looped portions formed on one ends of a plurality of joining hairs allowing said rod-like member to pierce therethrough and free ends side thereof being inserted respectively into and clamped by said plurality of cuts in said cushion member.

7. A joining hair retainer as claimed in claim 6, wherein said looped portions of said joining hairs, with said rod-like member pierced through said looped portions, are heated to curl so that said looped shape can be maintained.

8. A joining hair retainer as claimed in claim 7, wherein said heating is effected by blowing hot air to said rod-like member which has pierced through said joining hairs.

9. A joining hair retainer as claimed in claim 7, wherein said heating is effected by a heater contained in said rod-like member which has pierced through said joining hairs.

10. A joining hair retainer as claimed in claim 7, wherein said rod-like member is formed of a tubular material having a plurality of small holes through which vapor can be externally introduced therein, and said heating is effected by the vapor ejected from said small holes of said rod-like member which has been pierced through said joining hairs.

11. A joining hair retainer unit comprising a plurality of joining hair retainers as claimed in any one of claims 1 to 10 and firmly secured to a mount in parallel relation.

12. A joining hair retainer unit as claimed in claim 11, wherein the whole unit is vacuum packed.

* * * * *